US009630337B2

(12) United States Patent
Peng

(10) Patent No.: US 9,630,337 B2
(45) Date of Patent: Apr. 25, 2017

(54) PRODUCTION TECHNOLOGY FOR NATURAL BAMBOO FIBERS

(75) Inventor: Jianxin Peng, Chengdu (CN)

(73) Assignee: Yi Zhang, Fuzhou, Fujian (CN)

( * ) Notice: Subject to any disclaimer, the term of this patent is extended or adjusted under 35 U.S.C. 154(b) by 868 days.

(21) Appl. No.: 14/002,356

(22) PCT Filed: Mar. 21, 2011

(86) PCT No.: PCT/CN2011/071986
§ 371 (c)(1),
(2), (4) Date: Aug. 29, 2013

(87) PCT Pub. No.: WO2012/126168
PCT Pub. Date: Sep. 27, 2012

(65) Prior Publication Data
US 2014/0000761 A1 Jan. 2, 2014

(51) Int. Cl.
*B27J 7/00* (2006.01)
*D01B 9/00* (2006.01)
*D01C 1/00* (2006.01)

(52) U.S. Cl.
CPC *B27J 7/00* (2013.01); *D01B 9/00* (2013.01); *D01C 1/00* (2013.01)

(58) Field of Classification Search
CPC ..... B27J 1/00; B27J 1/02; B27J 7/00; B27J 5/00; B27M 1/08
See application file for complete search history.

(56) References Cited

U.S. PATENT DOCUMENTS 5,967,207 A * 10/1999 Chen ..... B27J 1/00 144/3.1
6,098,680 A * 8/2000 Nien ..... B27J 1/00 144/3.1
6,546,980 B2 * 4/2003 Chen ..... B27J 1/00 144/3.1
6,622,763 B2 * 9/2003 Chen ..... B27J 1/00 144/348
6,823,908 B2 * 11/2004 Hsu ..... B27J 1/00 144/347
7,473,455 B2 * 1/2009 Wang ..... B27D 1/04 264/109
7,647,957 B2 * 1/2010 Pasha ..... B27D 1/04 144/332
7,785,681 B2 * 8/2010 Liao ..... B25G 1/10 144/333
2008/0295982 A1 * 12/2008 Lee ..... D21C 5/00 162/60
2010/0178451 A1 * 7/2010 Li ..... B27J 1/00 428/106

* cited by examiner

*Primary Examiner* — Matthew G Katcoff
(74) *Attorney, Agent, or Firm* — Leong C. Lei

(57) ABSTRACT

A production technology for natural bamboo fibers is applied in producing woven bamboo fibers, non-woven bamboo fibers, and reinforcing composite bamboo fibers. The woven bamboo fibers are produced by steps of cutting to a certain length, slicing, flattening, softening, dividing, debonding, rinsing, soaking in oil, drying, and opening. The non-woven bamboo fibers and the reinforcing composite bamboo fibers are produced by steps of cutting to a certain length, slicing, flattening, softening, dividing, debonding (optional), rinsing, and drying.

17 Claims, 2 Drawing Sheets

PRODUCTION TECHNOLOGY FOR NATURAL BAMBOO FIBERS

BACKGROUND OF THE INVENTION

1. Field of the Invention

The present invention relates to a production technology for natural bamboo fibers, in particular to a production technology of woven bamboo fiber, non-woven bamboo fibers, and reinforcing composite bamboo fibers.

2. Description of the Related Art

The natural bamboo fibers, namely the bamboo fibers, are different from the bamboo pulp fibers and the bamboo charcoal fibers and belong to a kind of cellulose fibers which are directly extracted from the bamboos. The natural bamboo fibers are ranked at the fifth place of the developed natural fibers after the cotton, the wool, the silk, and the linen. By comparing with other natural fibers, the bamboo fibers have a lot of unique advantages. Due to the special construction, the bamboo fibers are able to transiently absorb and transmit water, and its properties of sweat absorbency and discharge, air-permeability, and heat conduction are more than thirty-folds of the cotton fibers, so the bamboo fibers are also called as breathing fibers. Furthermore, the bamboo fibers also provide a natural antibacterial property and deodorization. Therefore, the bamboo fibers will become environmental functional green fibers in 21$^{st}$ century.

According to different purposes, the natural bamboo fibers are defined as woven bamboo fibers, non-woven bamboo fibers, and reinforcing composite bamboo fibers. General natural bamboo fibers, such as short or coarse bamboo fibers, or bamboo powder, adopt a simple and extensive producing technology. However, the natural bamboo fibers used in the woven and non-woven fields have a higher difficulty in the production because the required length, fineness, and breaking strength thereof have to be adapted to the production of the downstream products.

The published documents and patents in China that relate to the technology of producing the natural bamboo fibers all mentioned of the producing technology of the bamboo fibers. Referring to the China Patent number 200910111625.4, namely the publication number CN101538744, issued at 23, Sep. 2009, is disclosed. This prior patent discloses a method for producing bamboo fibers, which comprises steps of sawing off, splitting, and softening the bamboo, and sending the bamboo to a bamboo splitting separator to attain carding, dividing, and airflow classifying for obtaining bamboo filamentary fibers. The bamboo filamentary fibers are dried after being cooked, and are then dehydrated, oiled, and air-dried after being cleaned. The bamboo filamentary fibers are carried out with enzymatic treatment for obtaining coarse bamboo fibers. Subsequently, the bamboo filamentary fibers are carried out with fine treatment, cleaning and dehydrating, bleaching, cleaning, dehydrating and oiling, drying, and curing by emulsion for obtaining fine bamboo fibers. However, the processing technology of the prior patent is complicated, the procedures thereof are repeated, the producing efficiency is low, the processing cost is high, and there is only single finished product of the bamboo fibers, which cannot attain a continuous industrial production of different types of purposes and levels of the natural bamboo fibers, and cannot produce the required woven bamboo fibers in the spinning and weaving fields.

Referring to China patent number 200910111588.7, namely the publication number CN101538743A, issued at 23, Sep. 2009, is disclosed. This prior patent discloses a method of bamboo fibers, which provides a technology for preparing bamboo fiber by 1, 4-butanediol in a solvent method. This prior patent comprises steps of manufacturing bamboos into bamboo filaments; soaking the bamboo filaments in the solvent and heating to remove lignin, hemicellulose and other impurities on the surface of the cellulose, manufacturing into coarse bamboo fibers; beating the coarse bamboo fibers, rinsing with water simultaneously, and then spin-drying through a centrifuge; bleaching and cleaning; proceeding softening the bamboo fibers; soft-impressing the bamboo fibers; and stowing fermentation and curing so as to obtain the bamboo fibers with spinnability after opening and carding. The solvent adopted by the prior patent has high boiling point and stable chemical property, which can be recycled. Therefore, the whole technological process does not generate black liquor and seriously pollute the environment. The prior patent belongs to cleaning techniques. However, this prior method can only adopt new-cut bamboos, which need to be removed the outer thereof, soaked, and removed the bamboo joints while being produced into bamboo filaments. The process is complicated, and the bamboos are restricted by the series (selecting 1 or 2 types of the appointed series), the age (the age of the bamboos is selective), the length (according to the bamboo joints), and the thickness (equal standard of the bamboos). The selection of the bamboos has a certain restriction, and the fiber length thereof is also restricted.

Therefore, the conventional methods still have the following defects: 1. The selectivity to the bamboos of the natural bamboo fibers in processing. 2. The complexity and the restriction to the technology of the natural bamboo fibers in processing. 3. The continuity of the procedure of the natural bamboo fibers in processing. 4. The unity of the finished products of the natural bamboo fibers in processing.

SUMMARY OF THE INVENTION

It is an object of the present invention to provide a production technology for natural bamboo fibers which has simple and high-efficient producing methods, good technological adaptability, low producing cost, low energy consumption, low pollution, and high producing efficiency, and is able to continuously and industrially produce various types of products.

The production technology for natural bamboo fibers of the present invention is attained by the following steps:

Step 1 for cutting to a certain length: cutting an entire bamboo into a bamboo tube adapted to a length of a softening hanging railing and putting a trunk of the bamboo tube alone after cutting;

Step 2 for slicing: using a hitting slicer to cut the trunk of the bamboo tube into a plurality of arc laminations including an arc cross-section with an angle of 30-70° and then collecting the arc laminations with a same length for transporting to a next step;

Step 3 for flattening: using a roll flattening machine to flatten the arc laminations into flat laminations for putting the flat laminations in the softening hanging railing;

Step 4 for softening: soaking the softening hanging railing with the flat laminations in a softening tank for 24-180 hours to form a plurality of soft laminations. A temperature of the softening tank is defined at a normal atmospheric temperature or is heated to a temperature of 25-90° C. A softening liquor is compounded from water, sodium hydroxide, sodium carbonate, sodium sulfite, sodium silicate in a proportion of 30-95:1:2:0.5:0.2;

Step 5 for dividing: dividing the soft laminations into velvet bamboo filaments by a bamboo material dividing apparatus;

a step 6 for debonding: in a production of woven bamboo fibers, adopting a chemical debonding process and a biological debonding process or adopting only the chemical debonding process and then processing steps 7-11 for getting the woven bamboo fibers. In a production of non-woven bamboo fibers or reinforcing composite bamboo fibers, omitting a debonding process or adopting the biological debonding process, processing steps 7 and 9, and then processing step 11 for getting the non-woven bamboo fibers or the reinforcing composite bamboo fibers;

The chemical debonding process is achieved by putting the velvet bamboo filaments in a steam boiler or an autoclave and cooking the velvet bamboo filament for 30-120 minutes for generating cooked filaments. A cooking liquor is defined at a temperature of 60-180° C. and compounded from water, sodium hydroxide, sodium carbonate, sodium sulfite, sodium silicate in a proportion of 10-95:1-2:2-4:0.2-0.4:0.1-0.2;

The biological debonding process is achieved by soaking the velvet bamboo filaments or the cooked filaments in a rinsing acid liquor for neutralizing and soaking for 1-5 minutes in accordance with a condition of pH value of 3.5-7.5. A concentration of acid is set at 0.2-6%. The neutralized fibers are continuously rinsed until a complete removal of chemical residues, sprayed with a bio-enzyme evenly, tossed and shaken by manpower, and then stowed for 4-24 hours. The bio-enzyme is defined as one of a pectase, a ligninase, a cellulase, and a xylanase, or a compound thereof. A concentrated liquor of the bio-enzyme is set by a concentration of 0.5-35 g/l, a temperature at 30-65° C., and a pH value of 3-6;

Step 7 for rinsing: continuous-washing the velvet bamboo filaments processed by the biological debonding process for getting half-finished fibers with a complete removal of bio-enzymatic residues, or soaking the cooked filament processed by the biological-debonding process in the rinsing acid liquor for neutralizing and soaking for 1-5 minutes according to the pH value of 3.5-7.5. A concentration of acid is set at 0.2-6%. The neutralized fibers are continuously rinsed for getting the half-finished fibers with a complete removal of chemical residues;

Step 8 for soaking in oil: putting the half-finished fibers in an oil-soaking hanging railing after the fibers are drained, putting the half-finished fibers in an oil-soaking tank with an addition of an emulsified oil for 120-180 minutes. A temperature of the oil-soaking tank is defined at a normal atmospheric temperature or is heated to a temperature of 70-90° C., and a proportion of the half-finished fibers and the emulsified oil is 100:1.5-5;

Step 9 for drying: the half-finished fibers are taken out again for being dehydrated to a hydrous percentage of 45-50%. The dehydrated half-finished fibers are shaken and spread, and then are evenly put in a drying apparatus for being dried to a hydrous percentage of 10-15%;

Step 10 for opening: spraying an oil-water emulsifier on the dried half-finished fibers evenly, stowing and curing the dried half-finished fibers for 2-7 days, cutting the half-finished fibers in a certain length by a cutting-off machine, and processing continuously for 1-3 times by an opener for producing woven bamboo fibers. Each ton of the half-finished fibers is sprayed with 30-150 kilograms of the oil-water emulsifier. The oil-water emulsifier is compounded from the emulsified oil and water in a proportion of 0.5:1. The opener is controlled by the following technological parameters which are sequentially processed by a beater at a rotation speed of 730-750 rpm, by a porcupine beater at a rotation speed of 420-490 rpm, by a combined beater at a rotation speed of 850-900 rpm, and then rolling the fibers with a rotation speed of 9-11 rpm; and Step 11 for finishing: packing finished products for storing in a storehouse.

The present invention provides the following advantages: The slicing and flattening steps of the technological steps are able to directly mechanically process the entire bamboo or the bamboo remnant without slicing radially, which fully combine the physical, biological, and chemical producing technologies for attaining the industrial high-efficiency production of the natural bamboo fibers. Because of the slicing, flattening, and dividing steps, the processing technology is not restricted by the bamboo series, age, length, and thickness. The producing procedure is simple, reliable, and high-efficient, the resource utilizing rate is high, the equipments are reasonably arranged, the producing procedure is coherent, and the technology is easy to control, which attains a mass production of high efficiency, continuity, and industrialization, reduces the producing cost, and produces natural bamboo fibers with various purposes. Because the alkali generated from the softening and cooking procedures is neutralized by the acid of the rinsing procedure, it causes little environmental pollution and provides a stable product quality. The natural bamboo fibers of the present invention provide equal length and thickness, high fiber strength, good ductility, good humidity absorbency and discharge, high air-permeability, in particular to the germproof and deodorant properties. The present invention belongs to a new type of natural functional fibers which have superior properties and price. The non-woven bamboo fibers and the reinforcing composite bamboo fibers are extensively applied to automotive inner decorations, composite materials, building materials, and environmental materials fields. The woven bamboo fibers can be extensively applied to spun woven, non-woven, sanitary utensils, and household decorations fields.

DETAILED DESCRIPTION OF THE PREFERRED EMBODIMENTS

Figure 1:
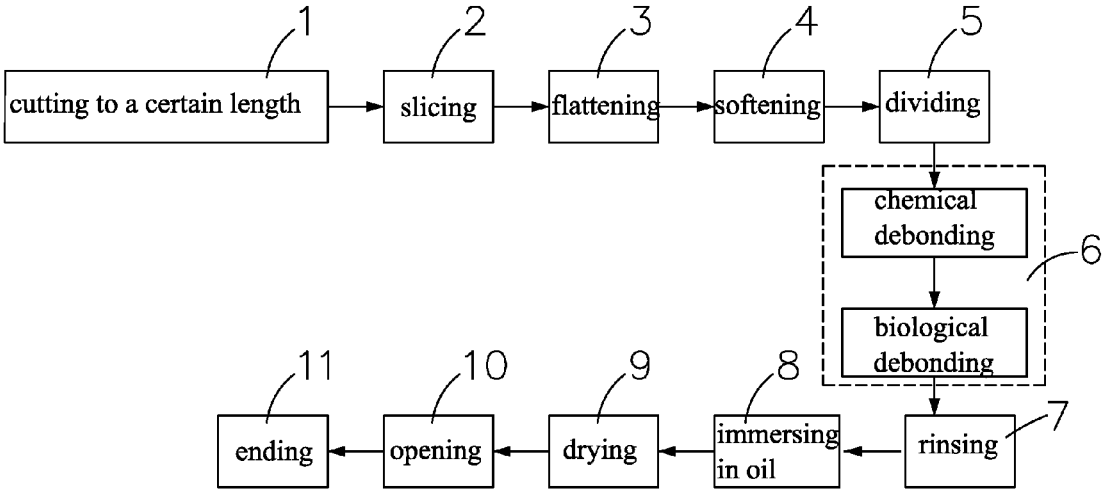
FIG. 1 is a flow view showing a first preferred embodiment of the production technology for woven bamboo fibers of the present invention.

Before describing in detail, it should note that the like elements are denoted by the similar reference numerals throughout disclosure.

Referring to FIG. 1, a first preferred embodiment of the present invention is shown. A production technology for woven bamboo fibers comprises the steps of:

Step 1 for cutting to a certain length: An entire bamboo is cut into a bamboo tube adapted to a length of a softening hanging railing. A cut trunk of the bamboo tube and the tip of the bamboo are respectively stored. The tip of the bamboo is arranged as an off-cut, and the trunk of the bamboo tube is applied.

Step 2 for slicing: A hitting slicer is adopted to cut the trunk of the bamboo tube into a plurality of arc laminations which include an arc cross-section with an angle of 30-70°. The hit arc laminations with identical length are collected and transported to a next step.

Step 3 for flattening: A roll flattening machine is adopted to flatten the arc laminations into flat laminations. The flat laminations are sorted in a batch and put in the softening hanging railing. The bamboo is loosed during the above-mentioned steps which benefit a softening liquor to fully permeate into the inner of the bamboos. Moreover, the bamboo is broken after the arc lamination is ground, and the bamboo joint is basically removed, so that the bamboo surface and the outer of the bamboo do not need to be removed.

Step 4 for softening: The hanging railing with the flat laminations is soaked in a softening tank for 24 hours for being formed into a plurality of soft laminations. A temperature of the softening tank is set at 90° C. Softening liquor is compounded from water, sodium hydroxide, sodium carbonate, sodium sulfite, sodium silicate in a proportion of 35:1:2:0.5:0.2. This step is applied for dividing non-fibers, such as lignin and pectin, so that the bamboo is concurrently softened and adapted to the step requiring an enhanced dividing demand. Under the effect of the softening liquor, a non-crystallized area of the cellulose of the bamboo is wet and distended, the lignin is presented in a viscous-flowing state, and the hemicellulose loses its connecting effect, so that the plasticity of the bamboo is enhanced. Furthermore, the more hydrous percentage of the flat lamination bamboo contains, the better the plasticity thereof gets, thereby benefiting the following processing.

Step 5 for dividing: A cracking splitting machine is utilized to crack and divide the soft laminations into velvet bamboo filaments while the soft laminations are in a saturated hygrometric state.

Step 6 for debonding: Chemical debonding process is firstly adopted, and then the biological debonding process is processed:

a. Chemical debonding: Putting the above-mentioned velvet bamboo filaments in the autoclave for 30 minutes for generating cooked filaments. A temperature of the cooking liquor is defined at 180° C. The cooking liquor is compounded from water, sodium hydroxide, sodium carbonate, sodium sulfite, sodium silicate in a proportion of 15:1:2:0.2:0.1. Via cooking, the hemicellulose and part lignin are removed, and the bamboo fibers are softened and thinned.

b. Biological debonding: The cooked filament processed by the chemical debonding process is soaked in rinsing acid liquor in accordance for neutralizing and soaking for 1-5 minutes according to a pH value of 3.5-7.5. A concentration of acid is set at 0.2-6%. The neutralized fibers are continuously rinsed until a complete removal of chemical residues, sprayed with a bio-enzyme evenly, tossed and shaken by manpower, and then stowed for 4 hours. The bio-enzyme is defined as a compound of pectase, ligninase, xylanase, and cellulase. A concentrated liquor of the bio-enzyme is set by a concentration of 15 g/l, a temperature at 60° C., and a pH value of 5. The bio-enzymatic process removes the pectin and the lignin and part of the hemicellulose and cellulose, further softens and thins the bamboo fibers.

Step 7 for rinsing: The velvet bamboo filaments processed by the biological debonding process are continuously rinsed for obtaining the half-finished fibers without a complete removal of bio-enzymatic residues.

Step 8 for soaking in oil: The half-finished fibers are put in an oil-soaking hanging railing after being drained. The half-finished fibers are then put in an oil-soaking tank with an addition of a debonding emulsified oil for 120 minutes. A temperature of the oil-soaking tank is defined at a temperature of 90° C. A proportion of the half-finished fibers to the emulsified oil are defined as 100:2. Oil-soaking enhances the ductility of the half-finished fibers, reduces the friction, and benefits the weaving and spinning process.

Step 9 for drying: The half-finished fibers are taken out again for being dehydrated to a hydrous percentage of 45%. A rotational speed of a drier is controlled at a speed of 10 r/min. The dehydrated half-finished fibers are shaken and spread, and then are evenly put in a drying apparatus for being dried. A parameter of the drying apparatus is adjusted, so that a hydrous percentage of the half-finished fibers provide a hydrous percentage of 10% after being dried.

Step 10 for opening: The dried half-finished fibers are sprayed with an oil-water emulsifier, stowed and cured for 3 days, cut in 50 cm length long by a cutting-off machine, and processed continuously for 2 times by an opener. The dried half-finished bamboo fibers are still adhesive and have impurities. The lengths of the fibers are disproportionate, which have to be divided, carded, and impurity-removed by an opener after the fibers are cut off. The fibers are able to be divided and carded through this step for being produced into woven bamboo fibers. Each ton of the half-finished fibers is sprayed with 35 kilograms of the oil-water emulsifier. The oil-water emulsifier is compounded from the emulsified oil and water in a proportion of 0.5:1. The opener is controlled by the following technological parameters which are sequentially processed by beater at a rotation speed of 740 rpm, by a porcupine beater at a rotation speed of 480 rpm, by a combined beater at a rotation speed of 900 rpm, and then rolls the fibers with a rotation speed of 11 rpm.

Step 11 for finishing: Woven bamboo fibers with a thickness of 15-30 dtex and a length of 10-50 mm are produced. The finished products are packed for storing in a storehouse. The bamboo fibers provide equal length and thickness, high fiber strength, good ductility, good humidity absorbency and discharge, high air-permeability, in particular to the germ-proof and deodorant properties. The bamboo fibers belong to a new type of the natural functional fibers which have superior properties and price and are able to be extensively applied to spun woven, non-woven, sanitary utensils, and house hold decorations fields.

Figure 2:
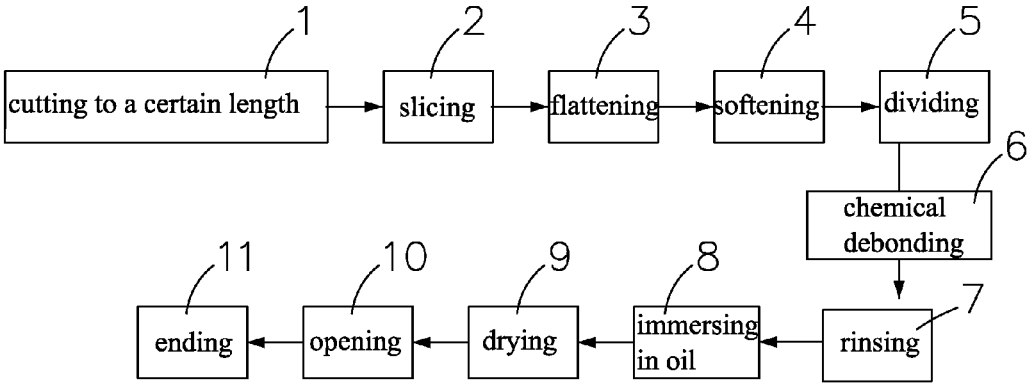
FIG. 2 is a flow view showing second and third preferred embodiments of the production technology for woven bamboo fibers of the present invention.

Referring to FIG. 2, a second preferred embodiment of the present invention is shown. A production technology for woven bamboo fibers comprises the steps of:

Steps 1, 2, and 3 are as same as the steps 1, 2, and 3 of the first preferred embodiment and herein are omitted.

Step 4 for softening: The hanging railing with the flat laminations is soaked in a softening tank for 120 hours for being formed into a plurality of soft laminations. A temperature of the softening tank is defined at a temperature of 25° C. Softening liquor is compounded from water, sodium hydroxide, sodium carbonate, sodium sulfite, sodium silicate in a proportion of 95:1:2:0.5:0.2. This step is applied for dividing non-fibers, such as lignin and pectin, so that the bamboo is concurrently softened and adapted to the step requiring an enhanced dividing demand. Under the effect of the softening liquor, a non-crystallized area of the cellulose of the bamboo is wet and distended, the lignin is presented in a viscous-flowing state, and the hemicellulose loses its connecting effect, so that the plasticity of the bamboo is enhanced. Furthermore, the more hydrous percentage of the flat lamination bamboo contains, the better plasticity thereof gets, thereby benefiting the following processing.

Step 5 for dividing: A carding splitting machine is utilized to card the soft laminations one by one for being divided into velvet bamboo filaments while the soft laminations are in a saturated hygrometric state. The velvet bamboo filaments processed by carding and dividing are manually picked so as to remove part of the bamboo laminations or bamboo blocks that do not turn into a fiber-shape. A color of the bamboo filaments processed by carding and dividing is mostly presented in a color of yellowish brown.

Step 6 for chemical debonding: The above-mentioned velvet bamboo filaments are put in a steam boiler for 45 minutes in order to generate cooked filaments. A temperature of cooking liquor is defined at a temperature of 75° C. The cooking liquor is compounded from water, sodium hydroxide, sodium carbonate, sodium sulfite, sodium silicate in a proportion of 95:2:4:0.4:0.2. Via cooking, the hemicellulose and part of the lignin are removed, and the bamboo fibers are softened and thinned.

Step 7 for rinsing: the cooking filaments processed by the chemical debonding process are soaked in a rinsing acid liquor for neutralizing and soaking for 4 minutes in accordance with a pH value of 7 in order to generate half-finished fibers. A concentration of the acid is set by 0.2%. The neutralized half-finished fibers are continuously rinsed for getting the half-finished fibers with a complete removal of chemical residues.

Step 8 for soaking in oil: The half-finished fibers are put in an oil-soaking hanging railing after being drained. The half-finished fibers are put in an oil-soaking tank with an addition of a debonding emulsified oil for 180 minutes. A temperature of the oil-soaking tank is defined at a normal atmospheric temperature, and a proportion of the half-finished fibers to the emulsified oil is 100:5.

Step 9 for drying: the half-finished fibers are taken out again for being dehydrated to a hydrous percentage of 50%. A rotational speed of a drier is controlled at a speed of 20 r/min. The soaking in oil step enhances the softness of the half-finished fibers and reduces the friction so as to be convenient for the spin and weave process. The dehydrated half-finished fibers are shaken and spread, and then are evenly put in a drying apparatus for being dried. A parameter of the drying apparatus is adjusted, so that the half-finished fibers provide a hydrous percentage of 10% after being dried.

Step 10 for opening: The dried half-finished fibers are sprayed with an oil-water emulsifier, stowed and cured for 3 days, cut in 40 cm length long by a cutting-off machine, and processed continuously for 3 times by an opener. The dried half-finished bamboo fibers are still adhesive and have impurities. The lengths of the fibers are disproportionate, which have to be divided, carded, and impurity-removed by an opener after the half-finished bamboo fibers are cut off. The fibers are able to be divided and carded through this step for being produced into woven bamboo fibers. Each ton of the half-finished fibers is sprayed with 150 kilograms of the oil-water emulsifier. The oil-water emulsifier is compounded from the carding emulsified oil and water in a proportion of 0.5:1. The opener is controlled by the following technological parameters which are sequentially processed by a beater at a rotation speed of 730 rpm, by a porcupine beater at a rotation speed of 420 rpm, by a combined beater at a rotation speed of 850 rpm, and then rolls the fibers with a rotation speed of 9 rpm.

Step 11 for finishing: Woven bamboo fibers with a thickness of 10-30 dtex and a length of 15-40 mm are produced. The finished products are packed for storing in a storehouse. The bamboo fibers have equal length and the thickness, high fiber strength, good ductility, good humidity absorbency and discharge, high air-permeability, in particular to the germproof and deodorant properties. The bamboo fibers belong to a new type of the natural functional fibers which have superior properties and price and are able to be extensively applied to spun woven, non-woven, sanitary utensils, and household decorations fields.

Referring to FIG. 2, a third preferred embodiment of the present invention is shown. A production technology for woven bamboo fibers comprises the steps of:

Steps 1, 2, and 3 are as same as the steps 1, 2, and 3 of the first preferred embodiment and herein are omitted.

Step 4 for softening: The hanging railing with the flat laminations is soaked in a softening tank for 180 hours for being formed into a plurality of soft laminations. A temperature of the softening tank is set by 25° C. Softening liquor is compounded from water, sodium hydroxide, sodium carbonate, sodium sulfite, sodium silicate in a proportion of 95:1:2:0.5:0.2. This step is applied for dividing non-fibers, such as lignin and pectin, so that the bamboo is concurrently softened and adapted to the step requiring an enhanced dividing demand. Under the effect of the softening liquor, a non-crystallized area of the cellulose of the bamboo is wet and distended, the lignin is presented in a viscous-flowing state, and the hemicellulose loses its connecting effect, so that the plasticity of the bamboo is enhanced. Furthermore, the more hydrous percentage of the flat lamination bamboo contains, the better the plasticity thereof gets, thereby benefiting the following processing.

Step 5 for dividing: A rolling splitting machine is utilized to grind and divide the soft laminations sequentially and then knead the soft laminations mechanically for obtaining velvet bamboo filaments while the soft laminations are in a saturated hygrometric state.

Step 6 for chemical debonding: The above-mentioned velvet bamboo filaments are put in a steam boiler for 120 minutes in order to generate cooked filaments. A temperature of cooking liquor is defined at 60° C. The cooking liquor is compounded from water, sodium hydroxide, sodium carbonate, sodium sulfite, and sodium silicate in a proportion of 95:2:4:0.4:0.2. Via cooking, the hemicellulose and part of the lignin are removed and the bamboo fibers are softened and thinned.

Step 7 for rinsing: the cooking filaments processed by the chemical debonding process are then soaked in rinsing acid liquor for neutralizing and soaking for 4 minutes in accordance with a pH value of 7 in order to generate the half-finished fibers. A concentration of acid is defined as 0.2%. The neutralized fibers are continuously rinsed for getting half-finished fibers with a complete removal of chemical residues.

Step 8 for soaking in oil: The half-finished fibers are put in an oil-soaking hanging railing after being drained. The half-finished fibers are then put in an oil-soaking tank with an addition of a debonding emulsified oil for 150 minutes. A temperature of the oil-soaking tank is defined at 70° C., and a proportion of the half-finished fibers and the emulsified oil are 100:5. The soaking in oil step enhances the softness of the half-finished fibers and reduces the friction so as to be convenient for the spinning and weaving process. The emulsified oil in the step 8 can be debonding emulsified oil or other emulsified oil.

Step 9 for drying: the half-finished fibers are taken out again for being dehydrated to a hydrous percentage of 48%. A rotational speed of a drier is controlled at a speed of 20 r/min. The dehydrated half-finished fibers are shaken and spread, and then are evenly put in a drying apparatus for being dried. A parameter of the drying apparatus is adjusted, so that the half-finished fibers provide a hydrous percentage of 10% after being dried.

Step 10 for opening: The dried half-finished fibers are sprayed with an oil-water emulsifier, stowed and cured for 3 days, cut in a 80 cm length long by a cutting-off machine, and processed continuously for 1 time by an opener. The dried half-finished bamboo fibers are still adhesive and have impurities. The lengths of the fibers are disproportionate, which have to be divided, carded, and impurity-removed by an opener after the fibers are cut off. The fibers are able to be divided and carded through this step for being produced into woven bamboo fibers. Each ton of the half-finished fibers is sprayed with 150 kilograms of the oil-water emulsifier. The oil-water emulsifier is compounded from the carding emulsified oil and water in a proportion of 0.5:1. The opener is controlled by the following technological parameters which are sequentially processed by a beater at a rotation speed of 730 rpm, by a porcupine beater at a rotation speed of 420 rpm, by a combined beater at a rotation speed of 850 rpm, and then rolls the fibers with a rotation speed of 9 rpm.

Step 11 for finishing: Woven bamboo fibers with a thickness of 12-30 dtex and a length of 50-80 mm are produced. The finished products are packed for storing in a storehouse. The bamboo fibers have equal length and thickness, high fiber strength, good ductility, good humidity absorbency and discharge, high air-permeability, in particular to the germ-proof and deodorant properties. The bamboo fibers belong to a new type of the natural functional fibers which have superior properties and price and are able to be extensively applied to spun woven, non-woven, sanitary utensils, and household decorations fields.

Figure 3:
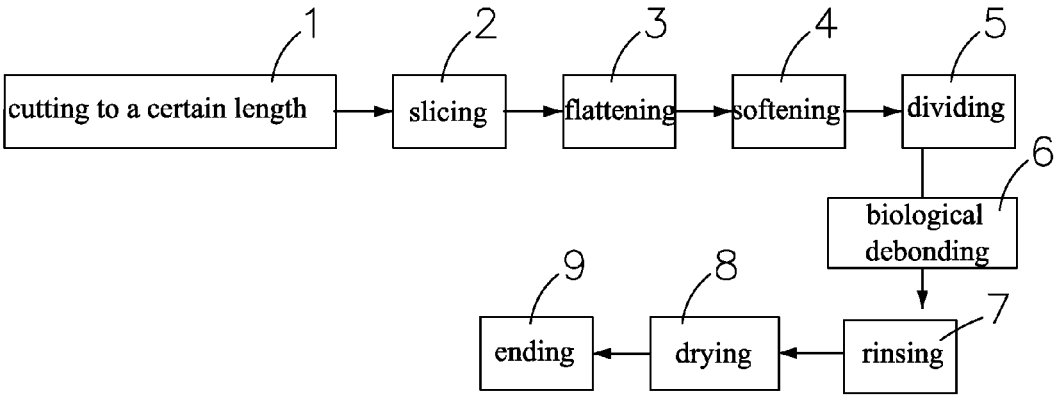
FIG. 3 is a flow view showing a fourth preferred embodiment of the production technology for non-woven bamboo fibers of the present invention.

Referring to FIG. 3, a fourth preferred embodiment of the present invention is shown. A production technology for non-woven bamboo fibers comprises the steps of:

Steps 1, 2, and 3 are as same as the steps 1, 2, and 3 of the first preferred embodiment and herein are omitted.

Step 4 for softening: The hanging railing with the flat laminations is soaked in a softening tank for 120 hours for being formed into a plurality of soft laminations. A temperature of the softening tank is defined at 25° C. Softening liquor is compounded from water, sodium hydroxide, sodium carbonate, sodium sulfite, sodium silicate in a proportion of 95:1:2:0.5:0.2. This step is applied for dividing non-fibers, such as lignin and pectin, so that the bamboo is concurrently softened and adapted to the step requiring an enhanced dividing demand. Under the effect of the softening liquor, a non-crystallized area of the cellulose of the bamboo is wet and distended, the lignin is presented in a viscous-flowing state, and the hemicellulose loses its connecting effect, so that the plasticity of the bamboo is enhanced. Furthermore, the more hydrous percentage of the flat lamination bamboo contains, the better the plasticity thereof gets, thereby benefiting the following processing.

Step 5 for dividing: This step is as same as the step 5 in the second preferred embodiment of the present invention, and herein is omitted.

Step 6 for chemical debonding: The velvet bamboo filaments generated from the above-mentioned steps are soaked in rinsing acid liquor for neutralizing and soaking for 1-5 minutes in accordance with a pH value of 3.5-7.5. A concentration of acid is defined as 0.2-6%. The neutralized fibers are continuously rinsed for getting the half-finished fibers with a complete removal of chemical residues. The neutralized fibers are sprayed with bio-enzyme, tossed and shaken by manpower, and then stowed for 12 hours. The bio-enzyme is defined as a compound of a pectase, a ligninase, and a xylanase. A concentrated liquor of the bio-enzyme is set by a concentration of 35 g/l, a temperature at 30° C., and a pH value of 5.5. Via the bio-enzymatic process, the pectase and the ligninase are removed, also the hemicellulose is partly removed, and the bamboo fibers are softened and thinned.

Step 7 for rinsing: The velvet bamboo filaments processed by the biological debonding process are continuous-washed for getting a half-finished fiber with a complete removal of bio-enzymatic residues.

Step 8 for drying: This step is as same as the step 9 in the second preferred embodiment, and herein is omitted.

Step 9 for finishing: Non-woven bamboo fibers with a thickness of 0.05-1.2 mm and a length of 20-100 mm are produced. The finished products are packed for storing in a storehouse. The bamboo fibers have high fiber strength, good ductility, rigid lightweight, and good sound insulation, in particular to the heat insulation property. The bamboo fibers belong to a new type of natural, green, environmental reinforcing fibrous material which is able to be extensively applied to automobile inner decorations, compound materials, building materials, and environmental materials fields.

Figure 4:
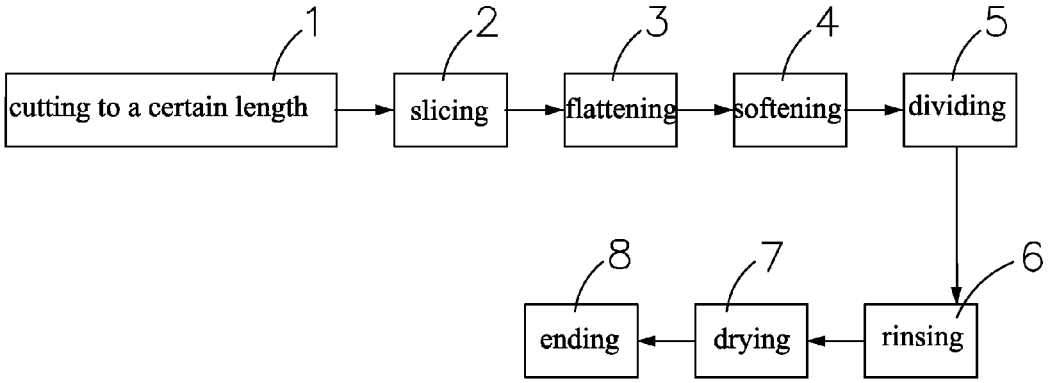
FIG. 4 is a flow view showing a fifth preferred embodiment of the production technology for reinforcing composite fibers of the present invention.

Referring to FIG. 4, a fifth preferred embodiment of the present invention is shown. A production technology for reinforcing composite bamboo fibers comprises the steps of:

Steps 1, 2, and 3 are as same as the steps 1, 2, and 3 of the first preferred embodiment and herein are omitted.

Step 4 for softening: The hanging railing with the flat laminations is soaked in a softening tank for 120 hours for being formed into a plurality of soft laminations. A temperature of the softening tank is defined at 25° C. Softening liquor is compounded from water, sodium hydroxide, sodium carbonate, sodium sulfite, sodium silicate in a proportion of 95:1:2:0.5:0.2. This step is applied for dividing non-fibers, such as lignin and pectin, so that the bamboo is concurrently softened and adapted to the step requiring an enhanced dividing demand. Under the effect of the softening liquor, a non-crystallized area of the cellulose of the bamboo is wet and distended, the lignin is presented in a viscous-flowing state, and the hemicellulose loses its connecting effect, so that the plasticity of the bamboo is enhanced. Furthermore, the more hydrous percentage of the flat lamination bamboo contains, the better the plasticity thereof gets, thereby benefiting the following processing.

Step 5 for dividing: This step is as same as the step 5 in the second preferred embodiment of the present invention, and herein is omitted.

Step 6 for rinsing: The velvet bamboo filaments generated from the above-mentioned steps are continuous-washed for getting a half-finished fiber with a complete removal of bio-enzymatic residues.

Step 7 for drying: The drying step is as same as the step 9 in the second preferred embodiment of the present invention, and herein is omitted.

Step 8 for finishing: Reinforcing composite bamboo fibers with a thickness of 0.1-1.5 mm and a length of 30-120 mm are produced. The finished products are packed for storing in a store house. The bamboo fibers have high fiber strength, good ductility, rigid lightweight, and good sound insulation, in particular to the heat insulation property. The reinforcing composite bamboo fibers belong to a new type of natural, green, environmental reinforcing fibrous material which is able to be extensively applied to automobile inner decorations, compound materials, building materials, and environmental materials fields.

While we have shown and described the embodiment in accordance with the present invention, it should be clear to those skilled in the art that further embodiments may be made without departing from the scope of the present invention.

I claim:

1. A method for producing natural bamboo fibers comprising:

a step 1 for cutting to a predetermined length: cutting an entire bamboo into a bamboo tube comprising a trunk having a predetermined length corresponding to a length of a softening hanging railing, with leaves of the bamboo being removed from the trunk, and storing said trunk of said bamboo tube after cutting;

a step 2 for slicing: using a slicer to cut said trunk of said bamboo tube into a plurality of arc laminations including an arc cross-section with an angle of 30-70° and then collecting said arc laminations with a same length for transporting to a next step;

a step 3 for flattening: using a roll flattening machine to flatten said arc laminations into flat laminations, and putting said flat laminations in said softening hanging railing;

a step 4 for softening: soaking said softening hanging railing with said flat laminations in a softening tank for 24-180 hours to form a plurality of soft laminations; a temperature of said softening tank being defined at a normal atmospheric temperature or being heated to a temperature of 25-90° C.; a softening liquor being compounded from water, sodium hydroxide, sodium carbonate, sodium sulfite, and sodium silicate in a proportion of 30-95:1:2:0.5:0.2;

a step 5 for dividing: dividing said soft laminations into velvet bamboo filaments by a bamboo material dividing apparatus;

a step 6 for debonding: applying a chemical debonding process and a biological debonding process sequentially to handle said velvet bamboo filaments so as to obtain woven bamboo fibers;

wherein said chemical debonding process is achieved by putting said velvet bamboo filaments in a steam boiler or an autoclave and cooking said velvet bamboo filaments for 30-120 minutes for generating cooked filaments, and a cooking liquor being defined at a temperature of 60-180° C.; said cooking liquor being compounded from water, sodium hydroxide, sodium carbonate, sodium sulfite, sodium silicate in a proportion of 10-95:1-2:2-4:0.2-0.4:0.1-0.2;

said biological debonding process is achieved by soaking said cooked filaments generated in said chemical debonding process in a rinsing acid liquor for neutralizing and soaking for 1-5 minutes to achieve a condition of pH value being 3.5-7.5 so as to obtain neutralized fibers; a concentration of acid being set at 0.2-6%; said neutralized fibers being continuously rinsed until complete removal of chemical residues, sprayed with a bio-enzyme evenly, tossed and shaken by manpower, and then stowed for 4-24 hours to obtain biologically-debonded bamboo filaments;

a step 7 for rinsing: continuously washing said biologically-debonded bamboo filaments to obtain half-finished fibers with complete removal of bio-enzymatic residues;

a step 8 for soaking in oil: putting said half-finished fibers in an oil-soaking hanging railing, putting said half-finished fibers in an oil-soaking tank with an addition of an emulsified oil for 120-180 minutes; a temperature of said oil-soaking tank being defined at a normal atmospheric temperature or being heated to a temperature of 70-90° C., and a proportion of said half-finished fibers to said emulsified oil being 100:1.5-5;

a step 9 for drying: removing said half-finished fibers from the hanging railing to have said half-finished fibers dehydrated to a hydrous percentage of 45-50%; said dehydrated half-finished fibers being shaken and spread, and then being evenly put in a drying apparatus for being dried to a hydrous percentage of 10-15%;

a step 10 for opening: spraying an oil-water emulsifier on said dried half-finished fibers evenly, stowing and curing said dried half-finished fibers for 2-7 days, cutting said half-finished fibers in a selected length by a cutting-off machine, and successively processing said half-finished fibers so cut in the selected length with an opener for 1-3 times for producing woven bamboo fibers; each ton of said half-finished fibers being sprayed with 30-150 kilograms of said oil-water emulsifier; said oil-water emulsifier being compounded from an emulsified oil and water in a proportion of 0.5:1; said opener being controlled to proceed sequentially with a beater operation at a rotation speed of 730-750 rpm, a porcupine beater operation at a rotation speed of 420-490 rpm, and a combined beater operation at a rotation speed of 850-900 rpm, and then rolling said fibers with a rotation speed of 9-11 rpm to obtain finished fiber product; and a step 11 for finishing: packing said finished fiber product for storing in a storehouse.

2. The method for producing natural bamboo fibers as claimed in claim 1, wherein said bamboo material dividing apparatus of step 5 includes a cracking splitting machine, a carding splitting machine, or a rolling splitting machine, and said soft laminations are rolled and divided sequentially and then kneaded mechanically during a dividing operation of said rolling splitting machine.

3. The method for producing natural bamboo fibers as claimed in claim 1, wherein step 5 is proceeded in a condition that said soft laminations are saturated with water contained in the softening liquor.

4. The method for producing natural bamboo fibers as claimed in claim 1, wherein said bio-enzyme of said biological debonding process of step 6 comprises one of pectase, ligninase, cellulase, and xylanase, or a combination thereof; a concentrated liquor of said bio-enzyme being set by a concentration of 0.5-35 g/l, a temperature at 30-65° C., and a pH value of 3-6.

5. The method for producing natural bamboo fibers as claimed in claim 1, wherein said emulsified oil of step 8 comprises a debonding emulsified oil, and said emulsified oil of step 10 comprises a carding emulsified oil.

6. The method for producing natural bamboo fibers as claimed in claim 2, wherein step 5 is proceeded in a condition that said soft laminations are saturated with water contained in said softening liquor.

7. A method for producing natural bamboo fibers comprising:

a step 1 for cutting to a predetermined length: cutting an entire bamboo into a bamboo tube comprising a trunk having a predetermined length corresponding to a length of a softening hanging railing, with leaves of the bamboo being removed from the trunk, and storing said trunk of said bamboo tube after cutting;

a step 2 for slicing: using a slicer to cut said trunk of said bamboo tube into a plurality of arc laminations including an arc cross-section with an angle of 30-70° and then collecting said arc laminations with a same length for transporting to a next step;

a step 3 for flattening: using a roll flattening machine to flatten said arc laminations into flat laminations, and putting said flat laminations in said softening hanging railing;

a step 4 for softening: soaking said softening hanging railing with said flat laminations in a softening tank for 24-180 hours to form a plurality of soft laminations; a temperature of said softening tank being defined at a normal atmospheric temperature or being heated to a temperature of 25-90° C.; a softening liquor being compounded from water, sodium hydroxide, sodium carbonate, sodium sulfite, and sodium silicate in a proportion of 30-95:1:2:0.5:0.2;

a step 5 for dividing: dividing said soft laminations into velvet bamboo filaments by a bamboo material dividing apparatus;

a step 6 for debonding: applying a chemical debonding process to handle said velvet bamboo filaments, wherein said chemical debonding process is achieved by putting said velvet bamboo filaments in a steam boiler or an autoclave and cooking said velvet bamboo filaments with a cooking liquor for 30-120 minutes for generating cooked filaments, wherein said cooking liquor is set at a temperature of 60-180° C. and said cooking liquor comprises a mixture of water, sodium hydroxide, sodium carbonate, sodium sulfite, sodium silicate at a ratio of 10-95:1-2:2-4:0.2-0.4:0.1-0.2;

a step 7 for rinsing: soaking said cooked filaments obtained with said chemical debonding process in a rinsing acid liquor for neutralizing and soaking for 1-5 minutes to achieve a condition of pH value being 3.5-7.5 so as to obtain neutralized fibers; a concentration of acid being set at 0.2-6%; said neutralized fibers being continuously rinsed until complete removal of chemical residues so as to obtain half-finished fibers;

a step 8 for soaking in oil: putting said half-finished fibers in an oil-soaking hanging railing, putting said half-finished fibers in an oil-soaking tank with an addition of an emulsified oil for 120-180 minutes; a temperature of said oil-soaking tank being defined at a normal atmospheric temperature or being heated to a temperature of 70-90° C., and a proportion of said half-finished fibers to said emulsified oil being 100:1.5-5;

a step 9 for drying: removing said half-finished fibers from the hanging railing to have said half-finished fibers dehydrated to a hydrous percentage of 45-50%; said dehydrated half-finished fibers being shaken and spread, and then being evenly put in a drying apparatus for being dried to a hydrous percentage of 10-15%;

a step 10 for opening: spraying an oil-water emulsifier on said dried half-finished fibers evenly, stowing and curing said dried half-finished fibers for 2-7 days, cutting said half-finished fibers in a selected length by a cutting-off machine, and successively processing said half-finished fibers so cut in the selected length with an opener for 1-3 times for producing woven bamboo fibers; each ton of said half-finished fibers being sprayed with 30-150 kilograms of said oil-water emulsifier; said oil-water emulsifier being compounded from an emulsified oil and water in a proportion of 0.5:1; said opener being controlled to proceed sequentially with a beater operation at a rotation speed of 730-750 rpm, a porcupine beater operation at a rotation speed of 420-490 rpm, and a combined beater operation at a rotation speed of 850-900 rpm, and then rolling said fibers with a rotation speed of 9-11 rpm to obtain finished fiber product; and a step 11 for finishing: packing said finished fiber product for storing in a storehouse.

8. The method for producing natural bamboo fibers as claimed in claim 7, wherein said bamboo material dividing apparatus of step 5 includes a cracking splitting machine, a carding splitting machine, or a rolling splitting machine, and said soft laminations are rolled and divided sequentially and then kneaded mechanically during a dividing operation of said rolling splitting machine.

9. The method for producing natural bamboo fibers as claimed in claim 7, wherein step 5 is proceeded in a condition that said soft laminations are saturated with water contained in the softening liquor.

10. The method for producing natural bamboo fibers as claimed in claim 7, wherein said bio-enzyme of said biological debonding process of step 6 comprises one of pectase, ligninase, cellulase, and xylanase, or a combination thereof; a concentrated liquor of said bio-enzyme being set by a concentration of 0.5-35 g/l, a temperature at 30-65° C., and a pH value of 3-6.

11. The method for producing natural bamboo fibers as claimed in claim 7, wherein said emulsified oil of step 8 comprises a debonding emulsified oil, and said emulsified oil of step 10 comprises a carding emulsified oil.

12. The method for producing natural bamboo fibers as claimed in claim 8, wherein step 5 is proceeded in a condition that said soft laminations are saturated with water contained in said softening liquor.

13. A method for producing natural bamboo fibers comprising:

a step 1 for cutting to a predetermined length: cutting an entire bamboo into a bamboo tube comprising a trunk having a predetermined length corresponding to a length of a softening hanging railing, with leaves of the bamboo being removed from the trunk, and storing said trunk of said bamboo tube after cutting;

a step 2 for slicing: using a slicer to cut said trunk of said bamboo tube into a plurality of arc laminations including an arc cross-section with an angle of 30-70° and then collecting said arc laminations with a same length for transporting to a next step;

a step 3 for flattening: using a roll flattening machine to flatten said arc laminations into flat laminations, and putting said flat laminations in said softening hanging railing;

a step 4 for softening: soaking said softening hanging railing with said flat laminations in a softening tank for 24-180 hours to form a plurality of soft laminations; a temperature of said softening tank being defined at a normal atmospheric temperature or being heated to a temperature of 25-90° C.; a softening liquor being compounded from water, sodium hydroxide, sodium carbonate, sodium sulfite, and sodium silicate in a proportion of 30-95:1:2:0.5:0.2;

a step 5 for dividing: dividing said soft laminations into velvet bamboo filaments, which are half-finished fibers, by a bamboo material dividing apparatus;

a step 6 for soaking in oil: putting said half-finished fibers in an oil-soaking hanging railing, putting said half-finished fibers in an oil-soaking tank with an addition of an emulsified oil for 120-180 minutes; a temperature of said oil-soaking tank being defined at a normal atmospheric temperature or being heated to a temperature of 70-90° C., and a proportion of said half-finished fibers to said emulsified oil being 100:1.5-5;

a step 7 for drying: removing said half-finished fibers from the hanging railing to have said half-finished fibers dehydrated to a hydrous percentage of 45-50%; said dehydrated half-finished fibers being shaken and spread, and then being evenly put in a drying apparatus for being dried to a hydrous percentage of 10-15%;

a step 8 for opening: spraying an oil-water emulsifier on said dried half-finished fibers evenly, stowing and curing said dried half-finished fibers for 2-7 days, cutting said half-finished fibers in a selected length by a cutting-off machine, and successively processing said half-finished fibers so cut in the selected length with an opener for 1-3 times for producing woven bamboo fibers; each ton of said half-finished fibers being sprayed with 30-150 kilograms of said oil-water emulsifier; said oil-water emulsifier being compounded from an emulsified oil and water in a proportion of 0.5:1; said opener being controlled to proceed sequentially with a beater operation at a rotation speed of 730-750 rpm, a porcupine beater operation at a rotation speed of 420-490 rpm, and a combined beater operation at a rotation speed of 850-900 rpm, and then rolling said fibers with a rotation speed of 9-11 rpm to obtain finished fiber product; and a step 9 for finishing: packing said finished fiber product for storing in a storehouse.

14. The method for producing natural bamboo fibers as claimed in claim 13, wherein said bamboo material dividing apparatus of step 5 includes a cracking splitting machine, a carding splitting machine, or a rolling splitting machine, and said soft laminations are rolled and divided sequentially and then kneaded mechanically during a dividing operation of said rolling splitting machine.

15. The method for producing natural bamboo fibers as claimed in claim 13, wherein step 5 is proceeded in a condition that said soft laminations are saturated with water contained in the softening liquor.

16. The method for producing natural bamboo fibers as claimed in claim 13, wherein said emulsified oil of step 6 comprises a debonding emulsified oil, and said emulsified oil of step 8 comprises a carding emulsified oil.

17. The method for producing natural bamboo fibers as claimed in claim 14, wherein step 5 is proceeded in a condition that said soft laminations are saturated with water contained in said softening liquor.

* * * * *